US006638186B2

(12) United States Patent
Williams

(10) Patent No.: US 6,638,186 B2
(45) Date of Patent: Oct. 28, 2003

(54) HOCKEY SKILL IMPROVEMENT SYSTEM HAVING PHYSIOLOGICAL MEMORY TRAINING

(76) Inventor: Scott A Williams, 22975 N. Prairie Rd., Prairie View, IL (US) 60069

( * ) Notice: Subject to any disclaimer, the term of this patent is extended or adjusted under 35 U.S.C. 154(b) by 93 days.

(21) Appl. No.: 09/834,859

(22) Filed: Apr. 16, 2001

(65) Prior Publication Data

US 2002/0151386 A1 Oct. 17, 2002

(51) Int. Cl.[7] ..... A63B 69/00; A63B 57/00; A63B 69/36

(52) U.S. Cl. ..... 473/446; 473/194; 473/144

(58) Field of Search ..... 473/422, 446, 473/471, 478, 132, FOR 132, 189, 224, 225

(56) References Cited

U.S. PATENT DOCUMENTS 3,955,815 A * 5/1976 Deschesnes ..... 473/144
4,070,017 A * 1/1978 Lombardi ..... 473/144
5,161,799 A * 11/1992 Nandra ..... 473/194
6,099,420 A * 8/2000 Nandra ..... 473/446

* cited by examiner

*Primary Examiner*—Paul T. Sewell
*Assistant Examiner*—Mitra Aryanpour
(74) *Attorney, Agent, or Firm*—James G. Staples

(57) ABSTRACT

A hockey practice device which provides physiological memory training to the user includes a low, short open bottom housing having a variable resistance striker puck which slides in a slot in the top of the housing, the puck being secured to a slider beneath the top which is secured to a variable tension extensible and retractable spring member having one end fixed to the housing and the other end to the slider, the entire assembly being only about five feet long or less so as to be usable indoors or outdoors in a minimal space.

1 Claim, 4 Drawing Sheets

HOCKEY SKILL IMPROVEMENT SYSTEM HAVING PHYSIOLOGICAL MEMORY TRAINING

This invention pertains generally to devices for improving hockey skills and particularly shooting skills. It may be used advantageously by players of all skill levels, requires no set-up or assembly, is equally suited for use both indoors and outdoors and has physiological memory training attributes which increase on-ice performance.

BACKGROUND OF THE INVENTION

With the great increase in popularity of youth hockey in recent years has come an attendant desire to improve necessary hockey skills. Because of hockey's popularity there is a concomitant increasing pressure for ice time for league play, and an accompanying decrease in ice time available for individual practice. Further, the requirement that daylight and evening hours accommodate both hockey and non-hockey ice activities, has generated a need for hockey players to increase their skills off the ice. Several devices have been proposed or reached the market directed to the objective of improving hockey skills by off ice practice, but none truly accomplishes the most important individual skill—shooting—in a simple, compact unit that can be easily used either indoors or outdoors in a minimum space. For example, one device which has reached the market requires over 15 feet of lineal space since the unit itself is 15 feet long and there must of course be additional space available at each end to give the participant standing and swinging room. As a consequence the device is impractical, indeed unusable, in the vast majority of indoor locations, such as an activity room in a home or a garage, and thus the device is only usable in an outdoor location such as a driveway or a tennis court. And since many outdoor locations are not lighted, the hours of use are usually limited to daylight hours which can of course be quite 5 brief, particularly in the winter in Northern states when the sun sets well before 5:00 p.m. during many weeks of the year. The device requires substantial assembly skills and time and is not adjustable to match the skill level of the user which may vary from a mite to a college level performer, or even a professional. And further the device, as a practical matter, is not portable, at least in the sense that it may conveniently be used at the home of participant A to on one day, at B's home the next day, and at C's home the third day with transfers made by the youngsters (who are most in need of skill development) without the assistance of adults.

A further deficiency in existing and proposed devices is that they do not have a positive carryover effect from the practice area; i.e.: a bedroom or a garage, to the ice. In other words, such known devices have no physiological memory training attribute in the sense that, in the mind of the user, none of the conditioning of the mind and body of the user resulting from use off ice carries over to on-ice time. Thus, on-ice and off-ice time do not merge in a physiological sense in the mind and body of a user.

For these and other reasons which will appear hereinafter there is an unmet need for a hockey skill development device which is adaptable to all skill levels from mites to professional, requires no assembly skill or time, is usable both indoors and outdoors at all hours of the day, is sufficiently light and rugged that it can be transferred from location to location by young hockey players with ease and provides physiological memory training to the user.

BRIEF DESCRIPTION OF THE DRAWING

The hockey skill improvement device of this invention is illustrated more or less diagrammatically in the accompanying drawing in which:

FIG. 3 is a partial perspective view to an enlarged scale as compared to

FIG. 2 of the underside of the hockey device; and

Like or identical reference numerals will be used to identify like or identical components form Figure to Figure in the drawing in the following detailed description of the invention.

DETAILED DESCRIPTION

Figure 1:
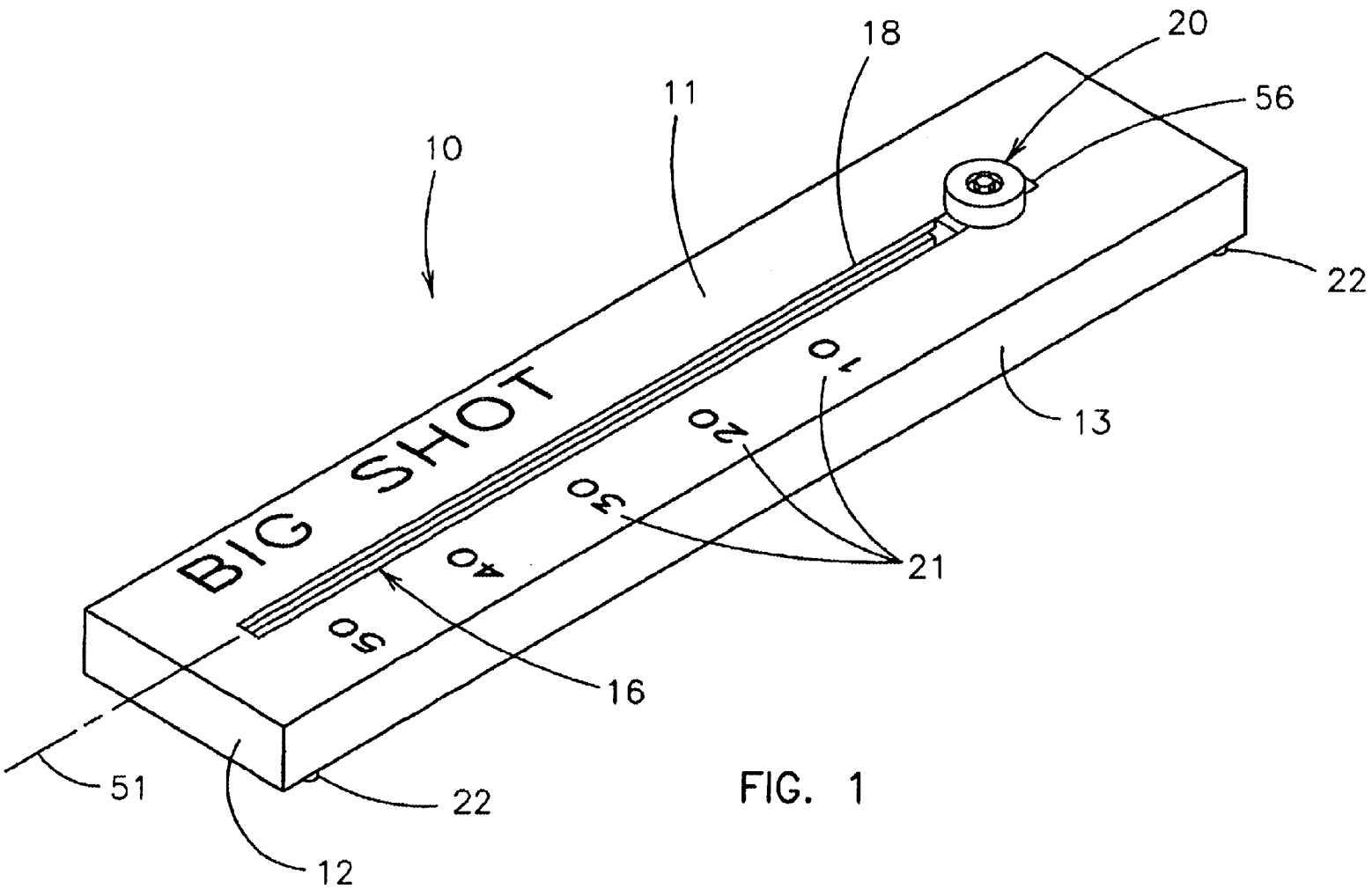
FIG. 1 is a perspective view of the hockey device of this invention, in its condition following removal from its shipping packaging and ready for use.

The hockey skill improvement device of this invention is indicated generally at 10 in FIG. 1. The device is here shown in the shape of an elongated rectangle and this is the shape it is currently contemplated will be most useful, but variations therefrom can undoubtedly be made within the spirit and scope of the invention. The device is equally adaptable for right handed or left handed stick handlers in the position of FIG. 1, it being understood that the right end of the device as viewed in FIG. 1 is the start or at rest position which is assumed prior to contact of the puck means by a hockey stick. The device, in this embodiment, has a framework consisting of top 11, front end 12, left side 13, right side 14 (see FIGS. 2–4) and rear end 15 (see FIGS. 2–4). The top, front, rear and sides form a support structure for a striker puck to be hereinafter described. An elongated slot 16 positioned parallel to the sides 12 and 14 and extending much of the length of the top is seen in its entirety in FIG. 1, the slot consisting of left side 17 and right side 18 as viewed from the rear end (see FIG. 4).

A striker puck, which may be, and preferably is, a modified regulation hockey puck, is indicated generally at 20. The puck is rotatably secured to a puck mounting assembly which, when struck by a hockey stick, slides along slot 16 and then automatically returns to the at rest or starting position of FIG. 1 as will be described hereinafter. A plurality of indicia are indicated at 21 alongside slot 16 whose purpose is to disclose the power applied to the striker puck by the user according to a convenient scale. Here a series of decade members have been shown but it will be understood that letters or any other readily understandable indicia, such as logos or animals (i.e.: chicken to elephant) could be used. Non-skid, slightly compressible support buttons are indicated at 22, the compressibility of the buttons 22 serving to help maintain the top 11 in a level horizontal plane when the device is placed on a slightly irregular surface.

Figure 2:
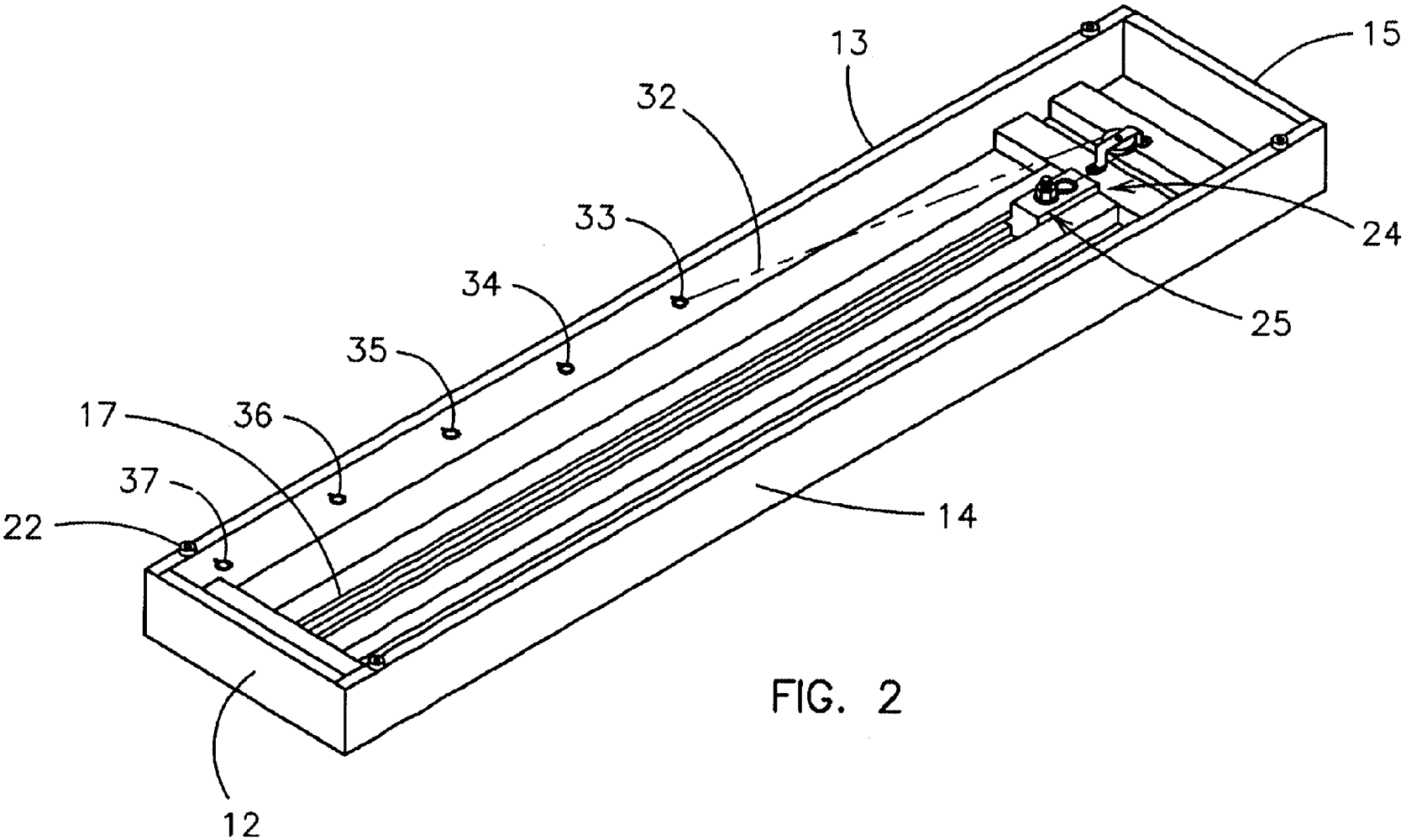
FIG. 2 is a perspective view of the underside of the hockey device of FIG. 1 illustrating particularly the adjustability of the striker puck return mechanism.
Figure 3:
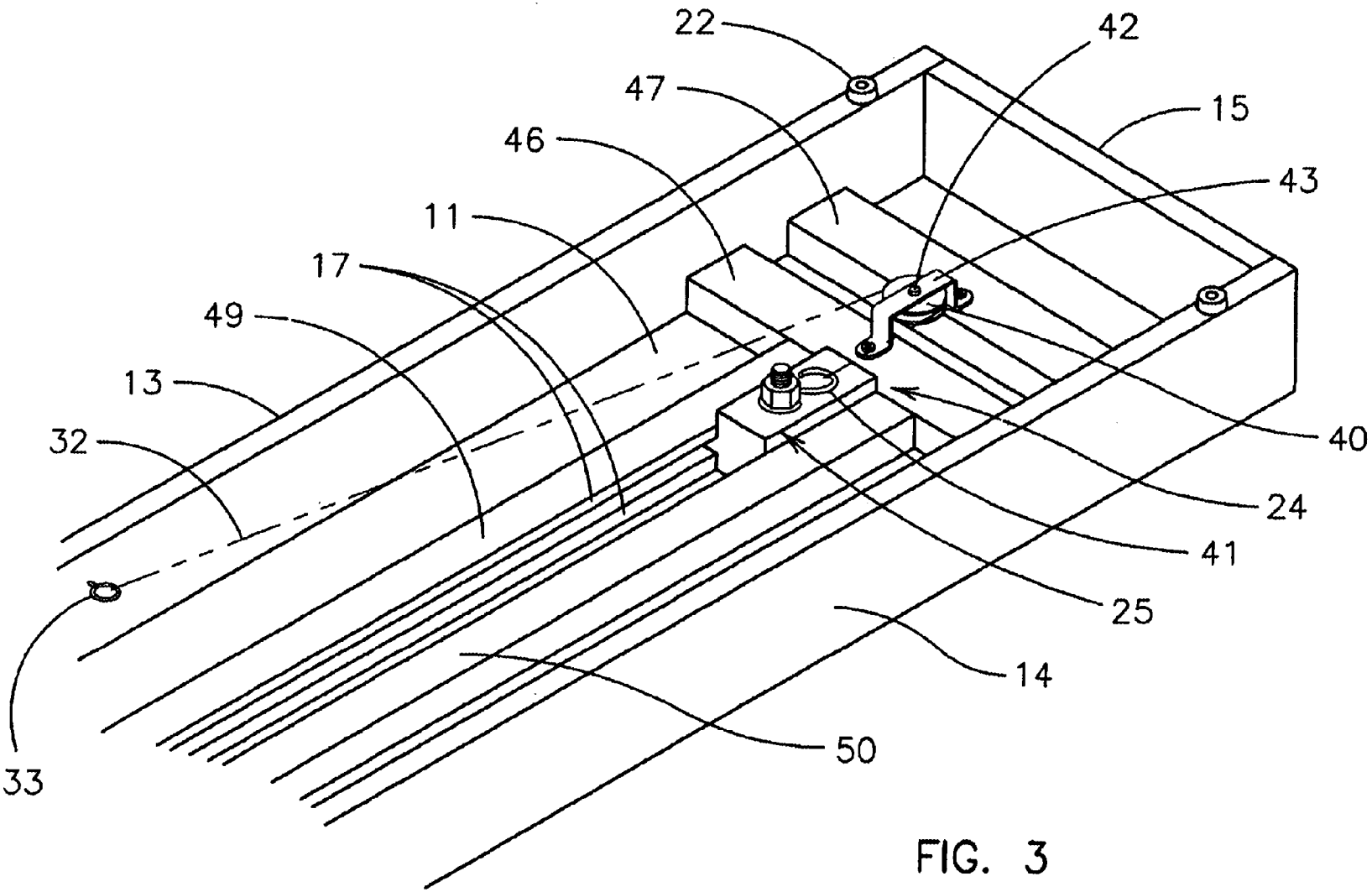

Referring now to FIGS. 2 and 3 particularly the puck mounting assembly is indicated generally at 24. Puck mounting assembly 24 includes a slider, indicated generally at 25, which is held to the striker puck 20 by any suitable fastener, here a carriage bolt 26. The top center of striker puck 20 is recessed, as at 27 (see FIG. 4), to a depth sufficient to receive the head 28 and a washer 29 so that the head 28 projects only very slightly, if any, above the top surface of striker puck 20. A nut 30 which is snugged up against the bottom surface of slider 25 secures the striker puck 20 to the slider. A clearance between the bores in the striker puck 20 and slider 25 are provided so that precise manufacturing tolerances are not required between the interfitting parts and the striker puck retains more of the "feel" of a regulation hockey puck.

Slider 25 is maintained in the position of FIG. 1 between strikings by an extensible and retractable return spring member indicated at 32. The front end of spring member 32 is secured by any suitable means to any one of, here five, anchors 33, 34, 35, 36 or 37 which project inwardly from the inside surface of left wall 13 (see FIG. 2). Here conventional eye screws have been shown with one eye screw located in vertical relationship with each of indicia 10, 20, 30, 40 and 50.

The other end of spring member 32 passes around a rotatable pulley 40, see FIGS. 2 and 3, and its rear end is secured by any suitable means to an anchor 41, here a conventional Shook, (see FIGS. 2 and 3). From FIG. 4 particularly it will be noted that nut 30 maintains anchor 41 fixed with respect to slider 25.

Pulley 40 rotates, preferably freely, around mounting pin 42 which projects downwardly from an inverted generally U-shaped mounting strap 43. The outwardly extending feet of the mounting strap are secured to a pair of mounting blocks 46, 47 which extend between the inside surfaces of walls 13 and 14. Obviously a single piece may take the place of the two mounting blocks 46, 47.

Figure 4:
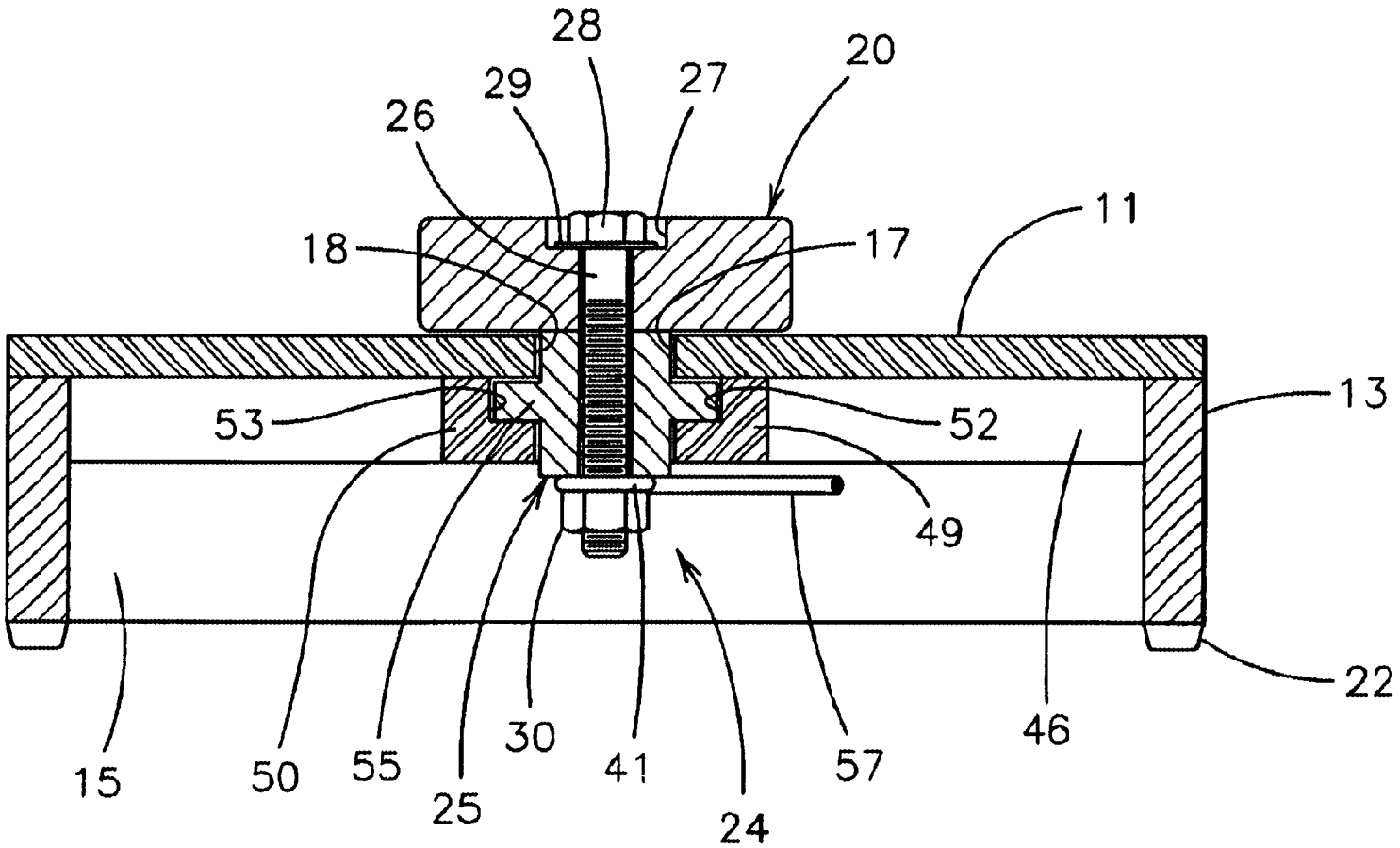
FIG. 4 is a view taken substantially along line 4—4 of FIG. 1.

A pair of generally L-shaped rails which are secured to the underside of top 11 are indicated generally at 49, 50, see particularly FIG. 4. The horizontal bar of each rail faces toward the center axis 51 (see FIG. 1), to form indented elongated slots 52, 53, one on either side of the central axis and parallel to it. The slots 52, 53 receive left and right wings 54 and 55 which extend outwardly from the mid-portion of slider 25 into sliding relationship with slots 52, 53, respectively.

Spring member 32 is formed from any material which has the ability to extend under impetus of a striking blow by a hockey stick against striker puck 20, and retract when the momentum provided by the hockey stick is overcome by the increasing return tension inherent in the spring member 32. The return travel of the striker puck 20 will of course be limited when the slider 25 butts against the rear end 56 of slot 16. Preferably the spring member has the characteristics with respect to extension and retraction of rubber. Although many suitable cross sections may be employed in the spring member, the simple round tube is illustrated at 57 in FIG. 4 has been found to give excellent results.

The use and operation of the invention is believed to be apparent from the foregoing description. Starting from the position of FIG. 1, a user strikes the striker puck 20 with his or her hockey stick swinging in a direction moving toward the highest numbered indicia on the top 11 of the device, here the numeral "50". The momentum imparted to the puck 20 by the hockey stick will keep the puck moving toward indicia "50" until the increasing tension on the slider 25 which is exerted in the opposite direction by the extension of spring member 32 equals the momentum of the puck 20 at which time forward movement of the puck will stop for an instant and then the slider will reverse direction under the pull or tension of the contracting spring member 32 to complete a cycle.

As a hockey user acquires increased skill and strength, the tension in spring member 32 may be increased by securing the forward end of spring member 32 to anchors successively more remote from anchor 33, thereby requiring more striking power by the user to move the striker puck the same distance from the rear end 56 of slot 16.

In addition, the device provides physiological memory training at all skill levels of the user which is largely derivable from the tension of spring member 32. Thus, as the user hits striker puck 20 repeatedly both his mind and his body are physiologically conditioned to expect resistance to the impact of his stick against the striker puck. As a consequence, when the user puts on his/her skates and takes to the ice, the loose puck on the ice will be struck with more power and emphasis due to the prior conditioning of the user's mind and body to expect resistance to contact with the stick On ice shooting skill is thereby increased to a markedly higher level, or at least the power aspect of it, than can be attributed to known devices which lack the resistance, and increasing resistance, characteristics of the device of this invention.

It is not possible to specify an exact number of strikes which will result in the desired physiological memory training of a hockey participant because the factors of age, coordination, physical strength and training susceptibility will vary from individual to individual. Indeed, such factors as alertness and fatigue, and the length of time lapse between the last practice strike of the puck and the first on-ice swing will all enter into the equation. Suffice it to say that it is always desirable to strike the puck off-ice a sufficient number of times starting from an at rest position to physiologically condition the mind and body of the user to the existence of a resistance to a striking of the puck prior to the first on-ice strike of the puck.

The device may be of any convenient length, though about five feet has been found to be entirely satisfactory, and it need be only about 2" in height. As a result the device may be used in a very small space, such as the open floor space in a conventional sized bedroom, easily transported and its position adjusted by young hockey players. The weight of the device will vary with the type of materials used and their thickness. Preferably the top 11, slider 25 and the rails 49, 50 are formed from plastic, or at least include a plastic surface, but the construction details may vary widely.

Although it is intended that the above description be taken as a representation of the invention in a broad sense along with a description of a specific embodiment, it will be understood that the scope of the invention should not be limited by the foregoing description but rather solely by the appended claims when interpreted in view of the relevant prior art.

What is claimed is:

1. A physiological memory training system for hockey players, said system including a support structure, said support structure having a top with a flat, uni-planar upper surface, a slot in the top extending through the upper surface, puck means, puck supporting means for enabling the puck means to travel along the slot from a beginning, at rest position to an extended, end of movement position, along a straight line path, spring means having one end portion thereof connected to the support structure and the other end portion connected to the puck means, said spring means exerting a return force on the puck means which increases as the puck means moves away from the beginning, at rest position under the impetus of a strike by a user, the spring means being a flexible, elongated strip have the characteristic of rubber, spaced indicia on the top surface at several locations alongside the slot, said indicia being regularly spaced along the slot means, the return force of the spring means being successively increasable by securing one end portion of the spring means at any one of a plurality of locations which are progressively a greater lineal distance from the location at which the minimum return force is exerted on the puck means, said indicia providing a visual indication to the user of the force exerted on the puck means following a strike so that the mind and body of the user can be physiologically conditioned to the resistance of the puck means upon application of a striking force against the puck means.

* * * * *